US009091007B2

(12) United States Patent
Chen et al.

(10) Patent No.: US 9,091,007 B2
(45) Date of Patent: Jul. 28, 2015

(54) ELECTROSPINNING APPARATUS WITH A SIDEWAY MOTION DEVICE AND A METHOD OF USING THE SAME

(71) Applicant: Taipei Medical University, Taipei (TW)

(72) Inventors: Chien-Chung Chen, Taipei (TW); Jen-Chang Yang, Taipei (TW); Keng-Liang Ou, Taipei (TW); Chen-Yu Liu, Taipei (TW); Cherng-You Ke, Taipei (TW)

(73) Assignee: TAIPEI MEDICAL UNIVERSITY, Taipei (TW)

( * ) Notice: Subject to any disclaimer, the term of this patent is extended or adjusted under 35 U.S.C. 154(b) by 0 days.

(21) Appl. No.: 13/709,612

(22) Filed: Dec. 10, 2012

(65) Prior Publication Data

US 2014/0162521 A1 Jun. 12, 2014

(51) Int. Cl.

| | |
|---|---|
| ***D01D 5/00*** | (2006.01) |
| ***D04H 1/728*** | (2012.01) |
| ***D01D 5/34*** | (2006.01) |

(52) U.S. Cl.

CPC ..... *D04H 1/728* (2013.01); *D01D 5/0061* (2013.01); *D01D 5/0069* (2013.01); *D01D 5/0076* (2013.01); *D01D 5/34* (2013.01)

(58) Field of Classification Search

CPC . D01D 5/0007; D01D 5/0061; D01D 5/0069; D01D 5/0076; D01D 5/34; D04H 1/728

USPC ..... 425/174.8 E, 377, 382.2, 461, 464

See application file for complete search history.

(56) References Cited

U.S. PATENT DOCUMENTS

| | | | | |
|---|---|---|---|---|
| 4,323,525 | A * | 4/1982 | Bornat | 264/441 |
| 2004/0096533 | A1* | 5/2004 | Dubson et al. | 425/115 |
| 2011/0159765 | A1* | 6/2011 | Fukasawa et al. | 442/268 |

FOREIGN PATENT DOCUMENTS

| | | | |
|---|---|---|---|
| JP | 2006-144138 | * | 6/2006 |
| TW | I314594 | | 9/2009 |
| TW | 201137195 | | 11/2011 |

OTHER PUBLICATIONS

Office action with a search report for the corresponding Taiwan Patent Application No. 101146732 dated Mar. 5, 2015.

English abstract translation of the Search Report for he corresponding Taiwan Patent Application No. 101146732 dated Mar. 5, 2015.

(Continued)

*Primary Examiner* — Yogendra Gupta

*Assistant Examiner* — Joseph Leyson

(74) *Attorney, Agent, or Firm* — WPAT, P.C.; Anthony King; Kay Yang

(57) ABSTRACT

The invention provides an electrospinning apparatus, which comprises one or more spinneret, a rotating collector disposed from the spinneret and configured to collect the fibers, and a sideway motion device disposed on or connected to the spinneret or the rotating collector and configured to propel or move the spinneret or the rotating collector, wherein the sideway motion device is controlled by a controlling unit for providing an angular speed (θ) of the sideway motion with a formula: $\theta=\tan^{-1} x/H$ wherein x is a parallel motion speed of the device and H is a vertical height between the spinneret and the rotating collector and wherein the angular speed (θ) is in a range of about $1.0\times10^{-4}$ to about 1.0 (°/sec). Also provided is the 2-D or 3-D membranes produced therefrom and a method of using the apparatus of the invention.

18 Claims, 11 Drawing Sheets

(a)

(b)

(56) References Cited

OTHER PUBLICATIONS

English abstract translation of TW201137195 dated Nov. 1, 2011.

English abstract translation of TWI314594 dated Sep. 11, 2009.

TW201137195 corresponds to US 2011/0264235 issued Oct. 27, 2011.

* cited by examiner

Fig. 7(a)
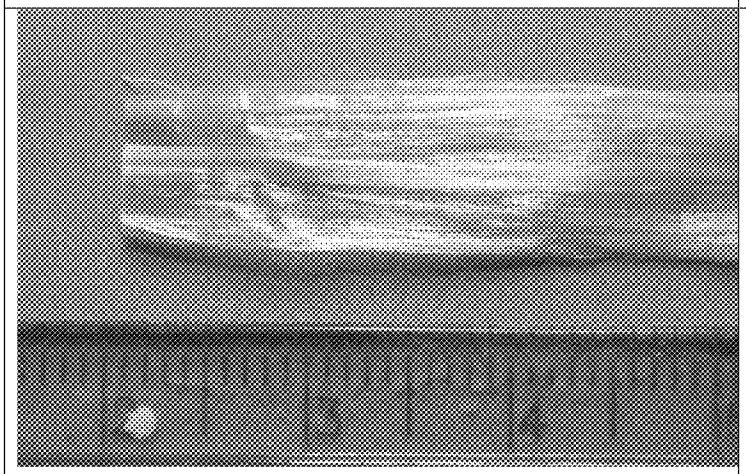
Fig. 7(b)
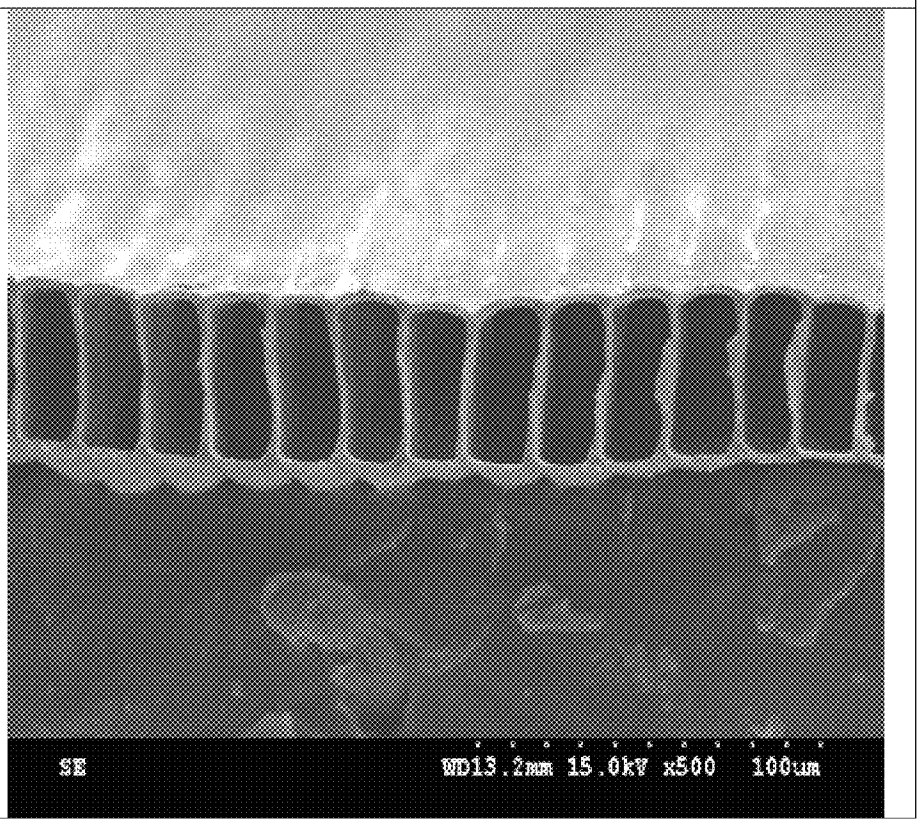
Fig. 7

ELECTROSPINNING APPARATUS WITH A SIDEWAY MOTION DEVICE AND A METHOD OF USING THE SAME

FIELD OF THE INVENTION

The invention relates to an electrospinning apparatus. Particularly, the invention provides an electrospinning apparatus with a spinneret, a collector disposed from the spinneret and configured to collect the fibers, and a sideway motion device disposed on or connected to the spinneret.

BACKGROUND OF THE INVENTION

There is a need for biomedical materials (preferably, biocompatible and biodegradable structural matrices) that facilitate tissue infiltration to repair/regenerate diseased or damaged tissue. Tissue engineering involves the development of a new generation of biomaterials capable of specific interactions with biological tissues to yield functional tissue equivalents. Most scaffolds can only introduce cells and/or signals after completion of the scaffold, due to the extreme conditions of the fabrication process, such as high or low temperature. The seeding of the cell in the inner part of a scaffold may be difficult, especially for larger objects with fine structural features. It would be very beneficial if cells could instead be introduced into the scaffold in situ. Furthermore, the addition of the chemical cues, such as growth factor, could be achieved in a controlled manner by fine tuning the degradation mechanism of biodegradable polymers such as collagen, polylactic acid and PCL.

It is known that nanotubes and nanofibers with core-sheath, hollow, or porous structures have many promising applications in a wide variety of technologies, including, for example, biomedical materials, scaffold and tissue regeneration and filtration. These fibers exhibit an especially advantageous combination of properties of being light-weight, flexible, permeable, strong and resilient in linear, two-dimensional and three-dimensional structures. In terms of biomedical application, there is great interest in devising a scaffold structure that mimics the tissue for better tissue regeneration. Highly aligned structures can be best represented by the structure of the nerve, vascular and some other tissues, or their parts.

Electrospinning is a process that relies on electric charges to deform a conical droplet of polymeric solution ejected from a nozzle tip into ultra-fine fibers. Electrospinning makes it relatively easy to spin continuous nanofibers from many different materials, including, but not limited to, polymers. Electrospinning provides a straightforward and practical way to produce fibers with diameters ranging from a few to about two-thousand nanometers. Electrospinning represents a versatile, low-cost method for producing micron- to nano-scale fibers in the form of either membrane or 3-dimensional structure. An apparatus for preparing electrospun nanofibers is introduced in Polym Int 56:1361-1366, 2007. WO 2005095684 is directed to substantially continuous fibers which have a core-and-shell structure; however, these fibers are randomly arranged, not aligned and packed. Currently there are only limited reports of production of highly aligned electrospun fibers, either by collecting fibers with a rotating disc (A. Theron, E. Zussmanl and A. L. Yarin, "Electrostatic field-assisted alignment of electrospun nanofibres," Nanotechnology, Vol. 12, P384-390, 2001), drum (P. Katta, M. Alessandro, R. D. Ramsier, and G. G. Chase, "Continuous Electrospinning of Aligned Polymer Nanofibers onto a Wire Drum Collector," Nano Lett., Vol. 4, No. 11, 2004) or frame (H. Fong, W-D. Liu, C-S. Wang, R A. Vaia, "Generation of electrospun fibers of nylon 6 and nylon 6-montmorillonite nanocomposite," Polymer, 43(3), P775-780, 2002), or with a set of parallel conductive substrates (Dan Li, Yuliang Wang, and Younan Xia, "Electrospinning of Polymeric and Ceramic Nanofibers as Uniaxially Aligned Arrays," Nano Lett., Vol. 3, No. 8, 2003). Some degree of fiber orientation with the aid of the multiple-field technique has also been reported (J. M. Deitzel, J. Kleinmeyer, J. K. Hirvonen, Beck T N C., "Controlled deposition of electrospun poly(ethylene oxide) fibers, " Polymer, Vol. 42, P8163-8170, 2001). Moreover, U.S. Pat. No. 7,575,707 discloses a method for electrospinning nanofibers having a core-sheath, tubular, or composite structure. However, the above references all have the disadvantage of limited alignment, which becomes even worse as the deposited fiber layers grow thicker. Also troublesome is the very limited production speed and/or small production quantity of electrospinning with needle type spinnerets, which makes it lack industrial value.

There are few reports on the preparation of nano/micro tubes by electrospinning process. Li et al. reported preparing nanotubes via a single capilliary electrospinning (Li, X. H. S., Chang L. and Liu, Yi C., A Simple Method for Controllable Preparation of Polymer Nanotubes via a Single Capillary Electrospinning. Langmuir, 2007, 23: p. 10920-10923). Core/sheath, PPy/PVP and hollow PVP nanofibers were also prepared by Srivastava using a hydrodynamic fluid focusing microchannel design (Srivastava, Y. R., C.; M.; Thorsen, T., Electrospinning hollow and core/sheath nanofibers using hydrodynamic fluid focusing; Microfluid Nanofluid, 2005, 5:p. 455-458). Di et al. prepared zeolite hollow fibers by calcinations of the as-spun fibers from coaxial electrospinning of the silicalite-1 nanoparticles in poly(vinyl pyrrolidone) (PVP)/ethanol solution to the outer shell and paraffin oil acted as the inner liquid (Di, J. C. C., H. Y., Wang, X. F., Zhao, Y, Yu, J. H. and Xu, R. R., Fabrication of Zeolite Hollow Fibers by Coaxial Electrospinning. Chem. Mater., 2008, 20(11): p. 3543-3545). However, none of them was able to prepare highly aligned and highly packed micro-tubes. Accordingly, there is a need to develop structurally aligned and closely packed fibers.

It was well known, to produce an electrospun membrane, particularly for wider ones, with consistent membrane thickness. Some types of motion in the width direction were applied either to the spinneret and/or collector so that the deposition of fibers could be spread out evenly. This side motion is usually fast along the axial direction of the collector; for example, speeds of 1 mm/sec up to several cm/sec were frequently used. The commercial electrospinning unit, such as the Nanon series unit of MECC Co. Ltd. Japan, has the spinneret traveling in the parallel direction of the collector's axis (in the fast motion mentioned above). Similar examples can be found in the publication by Barakat et al. (B, Barakat, N. A. M., et al., Titanium-based polymeric electrospun nanofiber mats as a novel organic semiconductor, Materials Science and Engineering. Vol. 177, Issue 1, 25 Jan. 2012, Pages 34-422012). However, such electrospinning unit is to arrange or pack the individual fibers together rather than to directly spin a microtube array membrane. US 20110264235 further provides a highly aligned and closely packed hollow fiber assembly, wherein the assemblies of fibrous membranes have a width-to-fiber diameter ratio (W/d) larger than 10 and the orientation of the fibers is no larger than +/−10 degrees. However, the fiber assembly obtained by the process of US 20110264235 is creased and requires extra labor/time to extend them for the next operation.

Accordingly, there is a need to develop a flat, high-quality microtube array (MTA) membrane.

SUMMARY OF THE INVENTION

One object of the invention is to provide an electrospinning apparatus, which comprises one or more spinneret, a rotating collector disposed from the spinneret and configured to collect the fibers, and a sideway motion device disposed on or connected to the spinneret or the rotating collector and configured to propel or move the spinneret or the rotating collector, wherein the sideway motion device is controlled by a controlling unit for providing an angular speed (θ) of the sideway motion with a formula: $\theta=\tan^{-1} x/H$ wherein x is a parallel motion speed of the device and H is a vertical height between the spinneret and the rotating collector and wherein the angular speed (θ) is in a range of about $1.0\times10^{-4}$ to about 1.0 (°/sec). Preferably, the angular speed (θ) is about $1.0\times10^{-4}$ to about 0.6 (°/sec) or about $1.89\times10^{-4}$ to about 0.573 (°/sec).

Another object of the invention is to provide a a method of using the apparatus of the invention to prepare a MTA membrane or a MTA membrane substrate. Preferably, the invention provides a method for preparing a MTA membrane or a MTA membrane substrate, comprising providing an electrospinning apparatus of the invention with one or more spinneret and a collector, providing an electrospray medium and electrospinning the electrospray medium with the electrospinning apparatus of the invention, wherein a sideway motion is provided with an angular speed (θ) with a formula: $\theta=\tan^{-1} x/H$ wherein x is a parallel motion speed of the side motion and H is a vertical height between the spinneret and the collector and wherein the angular speed (θ) is in a range of about $1.0\times10^{-4}$ to about 1.0 (°/sec).

BRIEF DESCRIPTION OF THE DRAWING

FIG. 1(*a*) shows the sideway motion device is connected to the spinneret and FIG. 1(*b*) shows the sideway motion device is connected to the rotating collector.

FIG. 7(*a*) shows off-white membrane and FIG. 7(*b*) shows the scanning electron microscope (SEM) image of PLLA-MTA membrane.

FIG. 8(*b*) shows the SEM image of the side view of PC/AB microcomposite MTA membrane. FIG. 8(*c*) shows the SEM image of the side view of PC/AB microcomposite MTA membrane after being torn apart.

FIG. 9(*c*) shows the SEM image of the side view of porous PLLA-MTA membrane.

DETAILED DESCRIPTION OF THE INVENTION

Figure 1:
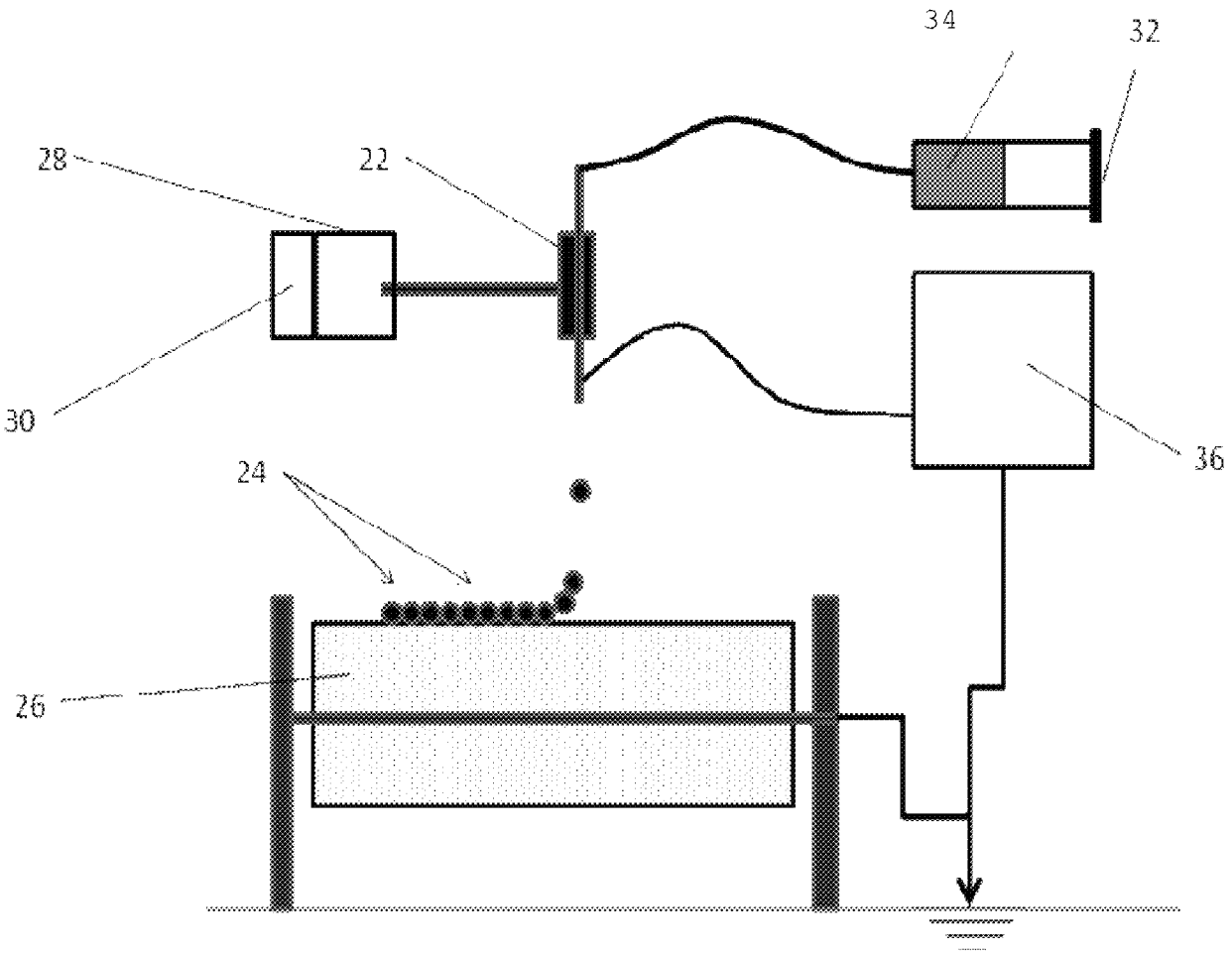
FIG. 1 shows a schematic illustration of an electrospinning apparatus according to the embodiments of the invention.
Figure 1:
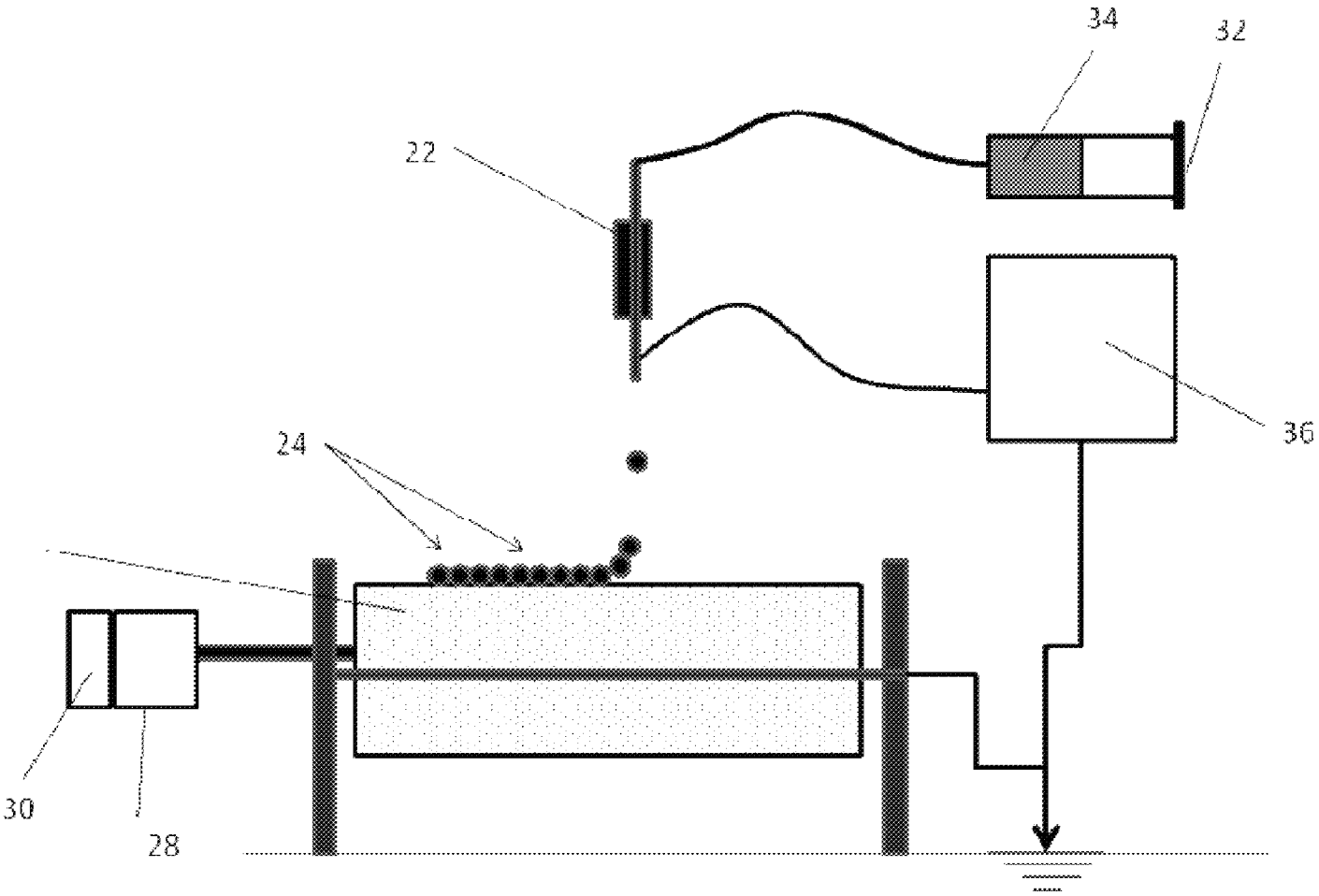

The invention develops an improved electrospinning system for producing flat, high-quality MTA membranes. The system provides a better quality membrane but saves time and cost, and the membrane produced therefrom is smooth and has a flat surface with no limitation on size, so it is welcome by industrial operation. In addition, the fibers in the membrane are completely sealed. Furthermore, with the newly improved system with better control of the electrospinning parameters, three-dimensional ordered scaffolds can be prepared.

Although many of the words, terms and titles employed herein are commonly used and conventionally understood within traditional medical and scientific contexts, summary descriptions and definitions of some terms and of particular names, designations, epithets or appellations are provided below. These descriptions and definitions are provided as an aid in recognizing and appreciating the true variety and range of applications intended for inclusion within the scope of the present methodology.

As used herein, the term "electrospinning" refers to a technology which produces nano-sized fibers referred to as electrospun fibers from a solution using interactions between fluid dynamics and charged surfaces. In general, formation of the electrospun fibers involves providing a solution to an orifice in a body in electric communication with a voltage source, wherein electric forces assist in forming fine fibers that are deposited on a surface that may be grounded or are otherwise at a lower voltage than the body. In electrospinning, a polymeric solution or melt provided from one or more needles, slots or other orifices is charged to a high voltage relative to a collection grid. Electrical forces overcome surface tension and cause a fine jet of the polymeric solution or melt to move towards the grounded or oppositely charged collection grid.

As used herein, the term "polymer" refers to and generally includes, but is not limited to, homopolymers, copolymers, such as, for example, block, graft, random and alternating copolymers, terpolymers, etc. and blends and modifications thereof. Preferably, it can include, but is not limited to, polylactides, polylactic acids, polyolefins, polyacrylonitrile, polyurethane, polycarbonate, polycaprolactone, polyvinyl alcohol (PVA), cellulose, chitosan nylon (e.g., nylon 6, nylon 406, nylon 6-6, etc.), polystyrene, proteins, and the like, or combinations thereof. Unless otherwise specifically limited, the term "polymer" is intended to include all possible geometrical configurations of the material. These configurations include, but are not limited to, isotactic, syndiotactic and random symmetries. Suitable solvents for each polymer can be selected from solvents known to those skilled in the art, including, but not limited to, sulfuric acid, formic acid, chloroform, tetrahydrofuran, dimethyl formamide, water, acetone, and combinations thereof.

As used herein, the term "nano-sized fibers" or "nanofibers" refers to very small diameter fibers having an average diameter not greater than about 1500 nanometers (nm). Nanofibers are generally understood to have a fiber diameter range of about 10 to about 1500 nm, more specifically about 10 to about 1000 nm, more specifically still about 20 to about 500 nm, and most specifically about 20 to about 400 nm. Other exemplary ranges include about 50 to about 500 nm, about 100 to 500 nm, or about 40 to about 200 nm. In instances where particulates are present and heterogeneously distributed on nanofibers, the average diameter of a nanofiber can be measured using known techniques (e.g., image analysis tools coupled with electro microscopy), but excluding the portions of a fiber that are substantially enlarged by the presence of added particles relative to the particle free portions of the fiber.

As used herein, the term "oriented fibers" indicates that substantially all fibers in a specific structure or array are arranged parallel to each other in a longitudinal direction ("unidirectionally oriented") or in a well-defined three-dimensional network ("three-dimensionally oriented"). In other words, the fibers are not randomly spatially arranged with respect to each other. In most instances, the fibers described herein grow in a generally perpendicular direction relative to the supporting substrate surface and there is very minimal, if any, branching of individual fiber strands.

As used herein, the term "single layer of material" or "single-layered material" refers to a material composed of a single layer which can be variable in thickness.

As used herein, the term "plurality of layers" or "multi-layered material" refers to a "stack" of single-layered materials.

In one aspect, the invention provides an electrospinning apparatus, which comprises one or more spinneret, a rotating collector disposed from the spinneret and configured to collect the fibers, and a side motion device disposed on or connected to the spinneret or the rotating collector and configured to propel or move the spinneret or the rotating collector, wherein the side motion device is controlled by a controlling unit for providing a parallel motion speed in a range of about 2 to about 50 micrometers/sec.

In one aspect, the invention provides an electrospinning apparatus, which comprises one or more spinneret, a rotating collector disposed from the spinneret and configured to collect the fibers, and a sideway motion device disposed on or connected to the spinneret or the rotating collector and configured to propel or move the spinneret or the rotating collector, wherein the sideway motion device is controlled by a controlling unit for providing an angular speed (θ) of the sideway motion with a formula: $\theta=\tan^{-1} x/H$ wherein x is a parallel motion speed of the device and H is a vertical height between the spinneret and the rotating collector and wherein the angular speed (θ) is in a range of about $1.0\times10^{-4}$ to about 1.0 (°/sec). Preferably, the angular speed (θ) is about $1.0\times10^{-4}$ to about 0.6 (°/sec) or about $1.89\times10^{-4}$ to about 0.573 (°/sec). More preferably, the angular speed (θ) is about 0.01 to about 0.1 (°/sec), about 0.01 to about 0.08 (°/sec), about 0.02 to about 0.072 (°/sec), about 0.02 to about 0.06 (°/sec), about 0.035 to about 0.055 (°/sec) or about 0.046 to about 0.068 (°/sec). Preferably, x is in a range of about 2 to about 50 micrometers/sec. More preferably, x is about 6 to about 45 micrometers/sec, about 6 to about 40 micrometers/sec, about 6 to about 35 micrometers/sec, about 6 to about 30 micrometers/sec, about 6 to about 25 micrometers/sec, about 6 to about 20 micrometers/sec, about 8 to about 45 micrometers/sec, about 8 to about 40 micrometers/sec, about 8 to about 35 micrometers/sec, about 8 to about 30 micrometers/sec, about 8 to about 25 micrometers/sec or about 8 to about 20 micrometers/sec; more further preferably, about 8 to about 20 micrometers/sec. Preferably, H is in a range of about 1 cm to 30 cm. More preferably, H is about 2 cm to about 20 cm, about 2 cm to about 15 cm, about 2 cm to about 10 cm, about 5 cm to about 20 cm, about 5 cm to about 15 cm, about 3 cm to about 15 cm, about 3 cm to about 10 cm, or about 10 cm to about 20 cm; more further preferably, about 3 cm to about 7 cm.

Referring now to the drawings, wherein like reference numerals designate identical, or corresponding parts throughout the several views, and more particularly to FIG. 1. FIG. 1 is a schematic illustration of an electrospinning apparatus 21 according to one embodiment of the present invention in which a spinneret 22 is configured to electrospin a substance from which fibers are composed to form fibers 24 (sectional view). The spinneret preferably is a coaxial spinneret. The electrospinning apparatus 21 includes a rotating collector 26 disposed from the spinneret 22 and configured to collect the fibers 24. The electrospinning apparatus 21 includes a sideway motion device 28 connected to the spinneret 22 and is controlled by a controlling unit 30 (see FIG. 1(*a*)). In another embodiment, the sideway motion device 28 connected to the rotating collector 26 and is controlled by a controlling unit 30 (see FIG. 1(*b*)). In a further embodiment, the sideway motion device 28 is disposed on the spinneret 22 or the rotating collector 26.

The controlling unit 30 is to provide an angular speed (θ) of the sideway motion with a formula: $\theta=\tan^{-1} x/H$ wherein x is a parallel motion speed of the sideway motion device 28 (preferably in a range of about 2 to about 50 micrometers/sec), and H is a vertical height between the spinneret 22 and the rotating collector 26 (preferably in a range of about 1 cm to 30 cm) and wherein the angular speed (θ) is in a range of about $1.0\times10^{4}$ to about 1.0 (°/sec). In one embodiment, the controlling unit 30 is disposed on the side motion device 28. In another embodiment, the controlling unit 30 is set in a computer. As to be discussed later, by providing the above-mentioned sideway motion, flat and two dimensional micro-tube array membranes (MTAM) can be produced by the device of the invention and the membranes are more acceptable for industry. Furthermore, three dimensional ordered MTAM substrates also can be produced in a controllable fashion.

The spinneret 22 communicates with a reservoir supply 32 containing the electrospray medium 34. The electrospray medium of the present invention includes polymer solutions and/or melts known in the art for the extrusion of fibers including extrusions of nanofiber materials. Examples of polymers include, but are not limited to, ethylene oxide, polyethylene oxide (PEO), ethylene glycol, polyethylene glycol (PEG), poly(lactic acid) (PLA), poly(glycolic acid) (PGA), poly(ethylene oxide) (PEO), nylon, polyesters, polyamides, poly(amic acids), polyimides, polyethers, polyketones, polyurethanes, polycaprolactones, polyacrylonitriles, polyaramides, conjugated polymers such as the electroluminescent polymer, poly(2-methoxy, 5 ethyl (2' hexyloxy) para-phenylene vinylene) (MEH-PPV), polyphenylenevinylenes, polyarylene-vinylenes, polythienolene-vinylenes, polypyrrolo-vinylenes, polyheteroarylene-vinylenes, polyanilines, polyphenylenes, polyarylenes, polythiophenes, polypyrroles, polyheteroarylenes, polyphenylene-ethynylenes, polyarylene-ethynylenes, polythieno-ethynylenes, polyheteroarylene-ethynylenes, and mixtures thereof.

In an embodiment of the invention useful for preparing hollow fibers having utility in medical applications, the polymer is a biodegradable and/or bioabsorbable polymer which contains a monomer selected from the group consisting of a glycolid, lactide, dioxanone, caprolactone and trimethylene carbonate. The phrase "contains a monomer" is intended to refer to a polymer which is produced from the specified monomer(s) or contains the specified monomeric unit(s). The polymer can be a homopolymer, random or block co-polymer or heteropolymer containing any combination of these monomers. The material can be a random copolymer, block copolymer or blend of homopolymers, copolymers, and/or heteropolymers that contain these monomers. In one embodiment, the biodegradable and/or bioabsorbable polymer contains bioabsorbable and biodegradable linear aliphatic polyesters such as polyglycolide (PGA) and its random copolymer poly(glycolide-co-lactide) (PGA-co-PLA). The Food and Drug Administration has approved these polymers for use in surgical applications, including medical sutures and scaffolds for tissue building. An advantage of these synthetic absorbable materials is their degradability by simple hydrolysis of the ester backbone in aqueous environments, such as body fluids. The degradation products are ultimately metabolized to carbon dioxide and water or can be excreted via the kidney. These polymers are very different from cellulose-based materials, which cannot be absorbed by the body. Other examples of suitable biocompatible polymers are polyhydroxyalkyl methacrylates including ethylmethacrylate, and hydrogels such as polyvinylpyrrolidone, polyacrylamides, etc. Other suitable bioabsorbable materials are biopolymers which include collagen, gelatin, alginic acid, chitin, chitosan, fibrin, hyaluronic acid, dextran and polyamino acids. Any combination, copolymer, polymer or blend thereof of the above examples is contemplated for use according to the present invention. Such bioabsorbable materials may be prepared by known methods. Particularly useful biodegradable polymers include poly-lactides, poly-glycolides, polycarprolactone, polydioxane and their random and block copolymers. Examples of specific polymers include poly D,L-lactide, polylactide-co-glycolide and polylactide-co-glycolide.

The electrospray medium, upon extrusion from the spinneret 22, is guided along a direction of an electric field directed toward the rotating collector 26. A pump (not shown) maintains a flow rate of the electrospray substance to the spinneret 22 at a desired value depending on the capillary diameter and length of the spinneret 22, and depending on the viscosity of the electrospray substance. Preferably, a filter can be used to filter out impurities and/or particles having a dimension larger than a predetermined dimension of the inner diameter of the spinneret 22. The flow rate through the spinneret 22 should be balanced with the electric field strength of the electric field so that a droplet shape exiting a tip of the spinneret 22 is constantly maintained.

Figure 2:
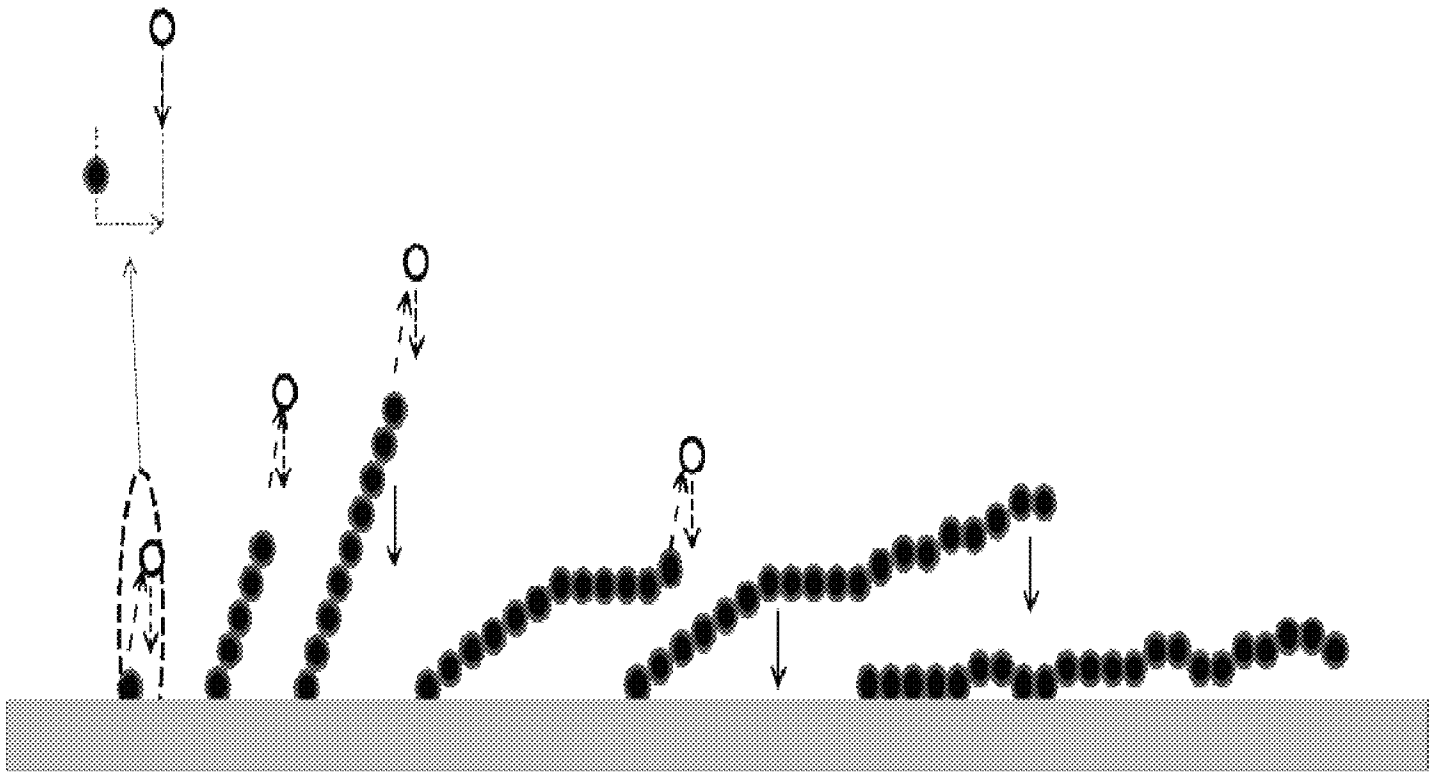
FIG. 2 shows the process of the formation of the MTA membrane by employing the side motion of the invention (○: Incoming fiber (sectional view); ✹: Landed fiber (sectional view); ↓: Fiber line stress (centrically); ⇣: Fiber incoming force; ⇡: Electrostatic attraction force).

Simultaneously, upon extrusion from the 22, the sideway motion device 28 propels or drives the spinneret 22 or the rotating collector 26 in parallel movement, and the controlling unit 30 controls the sideway motion device 28 and provides an angular speed (θ) of the sideway motion with a formula: $\theta=\tan^{-1} x/H$, wherein x is a parallel motion speed of the device and H is a vertical height between the spinneret 22 and the rotating collector 26. In the electrospinning process known in the art, the incoming fiber from the spinneret is deposited right on top of the previous landed one on the collector, while the number of fibers deposited increases, they will bend towards one side or the other side due to the force acted upon these fibers. Eventually, they will end up with a collapsed structure. On the contrary, by employing the sideway motion, the incoming fiber from the spinneret is deposited next to the previous landed one with a displacement in x-axis direction which is provided with an angular speed of the invention. While the number of fibers deposited increases, they will tend to line towards an x-axis direction and eventually fall flat on the surface of the collector with a continuous connected fiber structure (see FIG. 2).

A high voltage source 36 is provided to maintain the spinneret 22 at a high voltage. The rotating collector 28 is placed preferably 1 to 30 cm away from the tip of the spinneret 22. The collector 28 can be a plate or a screen. Typically, an electric field strength between 2,000 and 400,000 V/m (preferably, 0.5 kV/cm to 3 kV/cm) is established by the high voltage source 36. The high voltage source 36 is preferably a DC source, such as, for example, Bertan Model 105-20R (Bertan, Valhalla, N.Y.) or Gamma High Voltage Research Model ES30P (Gamma High Voltage Research Inc., Ormond Beach, Fla.). Typically, the fibers 24 produced by electrospinning from the spinneret 22 are directed by the electric field toward the collector 26.

Accordingly, the invention provides a method of using the apparatus of the invention to prepare a MTA membrane or a MTA membrane substrate. Preferably, the invention provides a method for preparing a MTA membrane or a MTA membrane substrate, comprising providing an electrospinning apparatus of the invention with one or more spinneret and a collector, providing an electrospray medium and electrospinning the electrospray medium with the electrospinning apparatus of the invention, wherein a sideway motion is provided with an angular speed (θ) with a formula: $\theta=\tan^{-1} x/H$ wherein x is a parallel motion speed of the side motion and H is a vertical height between the spinneret and the collector and wherein the angular speed (θ) is in a range of about $1.0\times10^{-4}$ to about 1.0 (°/sec). The embodiments of the electrospinning apparatus of the invention, the electrospray medium, the angular speed (θ), the parallel motion speed and the vertical height between the spinneret and the rotating collector are as mentioned above.

Accordingly, the invention also provides a microtube array membrane produced from the electrospinning apparatus of the invention, which is of 2-dimensional or 3-dimensional configuration. The fibers in the two-dimensional (2-D) or three-dimensional (3-D) MTA membranes prepared according to the invention are solid or hollow. The fiber diameter is not an essential characteristic of the invention. The average inner diameter of the fibers in the assembly is about 1 to about 100 μm (micrometer). More preferably, the average diameter is about 10 to about 50 μm or about 15 to about 25 μm. Most preferably, the average diameter is about 20+/−2 μm. The average wall thickness of fibers is about 0.1 to about 10 μm. More preferably, the average wall thickness is about 1 to about 5 μm. Most preferably, the average wall thickness is about 3 μm.

The 2-D or 3-D MTA membranes produced by the device of the invention can be used in various applications. For example, solid fiber membranes can be used as solid support or isolating material. Hollow fiber assembly can be used in biotechnology. The 2-D or 3-D MTA membranes of the invention can be prepared in various shapes for different applications including medical tissue engineering (such as scaffold, nerve guide conduit and vascular tube) and filtration units. For example, the 2-D or 3-D MTA membranes of the invention can be rolled into a tube with a tube-in-tube structure that can be used as a nerve guide conduit. In addition, the fiber assemblies can be stacked to form a filtration membrane.

In one embodiment, the 2-D or 3-D MTA membranes of this invention used as medical device/scaffold can be in situ seeded with cells, whereby the cells are suspended in the scaffold and exposed to the appropriate molecular cues in 3-D. These cell-seeded hollow fiber assemblies are useful in tissue replacement protocols. According to this embodiment, tissue can be reconstituted in vitro and then implanted into a host in need thereof. Useful cells include nerve cells, epithelial cells, endothelial cells, fibroblasts, myoblasts, chondroblasts, osteoblasts, and neural stem cells. Other cells that may be useful in the methods and fiber assemblies of this invention include, Schwann cells (WO 92/03536), astrocytes, oligodendrocytes and their precursors, adrenal chromaffin cells, and the like.

In another embodiment, the 2-D or 3-D MTA membranes of the invention can form porous membrane used as a microfiltration membrane for filtration, more particularly, a hollow fiber-form porous water filtration membrane.

Given the above, the 2-D or 3-D MTA membranes of this invention can be used in various fields such as hemodialysis, tissue engineering scaffold for nerve guide conduits, vascular grafts, hair regeneration scaffolds, microdialysis, bioreactors in biotech fields, hollow fiber assays for drug screening, gene chip modulus, in biomedical applications, water filtration, gas treatment in the chemical engineering industry, carbon capture and storage, hydrogen storage/carry devices for fuel cells, and microextraction in the analytical field.

EXAMPLE

Example 1

Figure 3:
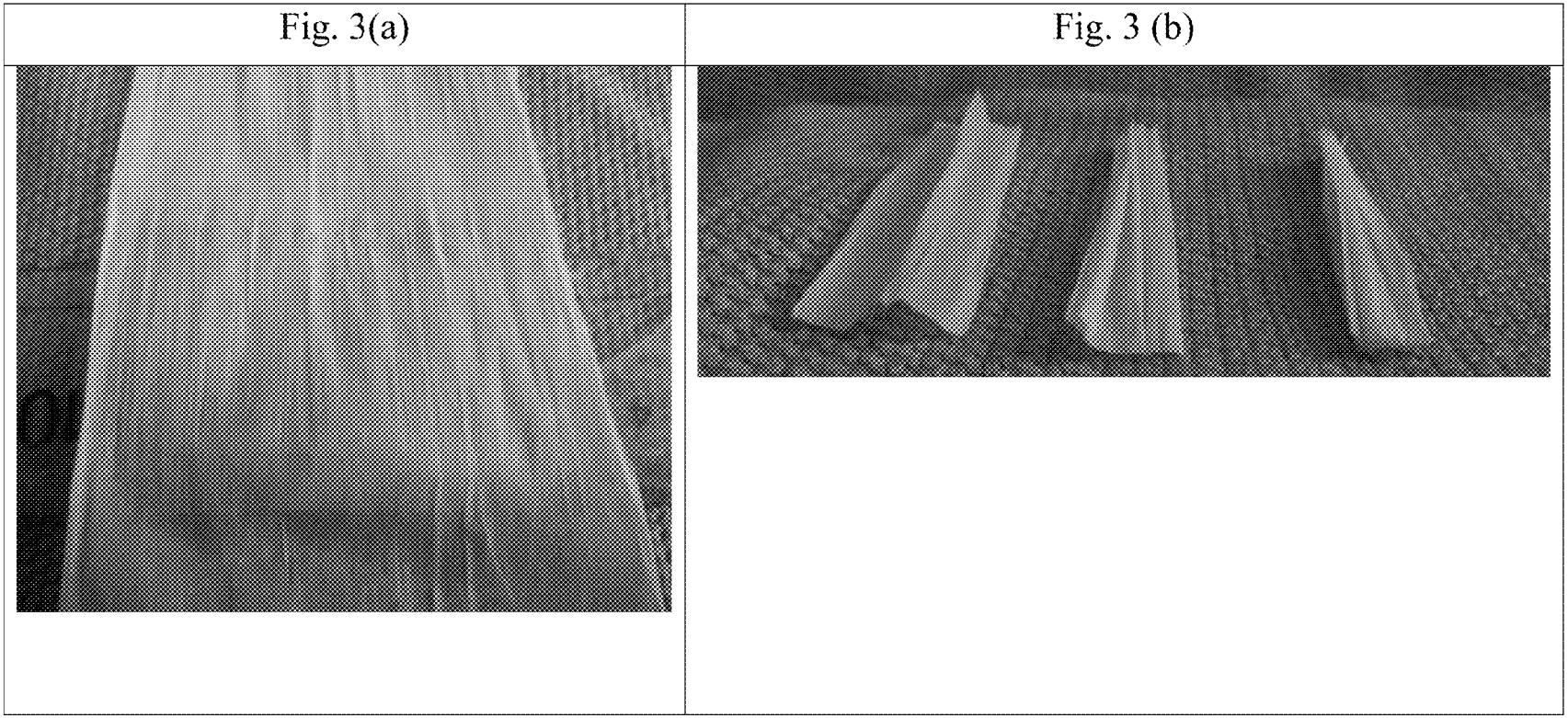
FIG. 3(*a*) shows a flat MTA membrane and FIG. 3(*b*) shows the sample obtained with the electrospinning process without side angular motion.

Typical Flat MTA Membrane Preparation and its Ancestor of Crumple MTA Membrane Co-axial electrospinning set-up with a specially modified collecting unit was used. Electrospinning was conducted with the following parameters: PLLA solution (17 wt % in dichloromethane/dimethylformamide (DCM/DMF (9:1) solution) and 10 wt % PEO/PEG (1:1) aqueous solution were used as shell and core dopes and delivered by syringes, each pumped at a rate of 5 ml/hr with the applied electrostatic field of 2.5 kV/cm. The collection unit was used to collect electrospun fiber with a rotating speed of 200 rmp (2.1 m/sec) and sideway angular motion of 0.095 degrees per sec (°/s). After 10 min of collection, flat, as-spun membrane, with the dimension of 5×30 $cm^2$ was collected, as shown in FIG. 3(*a*). The sample obtained under the same operation condition, except without the side motion was shown in FIG. 3(*b*). The as-spun, crumpled sample can be carefully expanded into a thin membrane, as shown in FIG. 3(*b*) from right to left.

Example 2

Flat MTA Membrane Fabrication Prepared with Different Conditions

Figure 4:
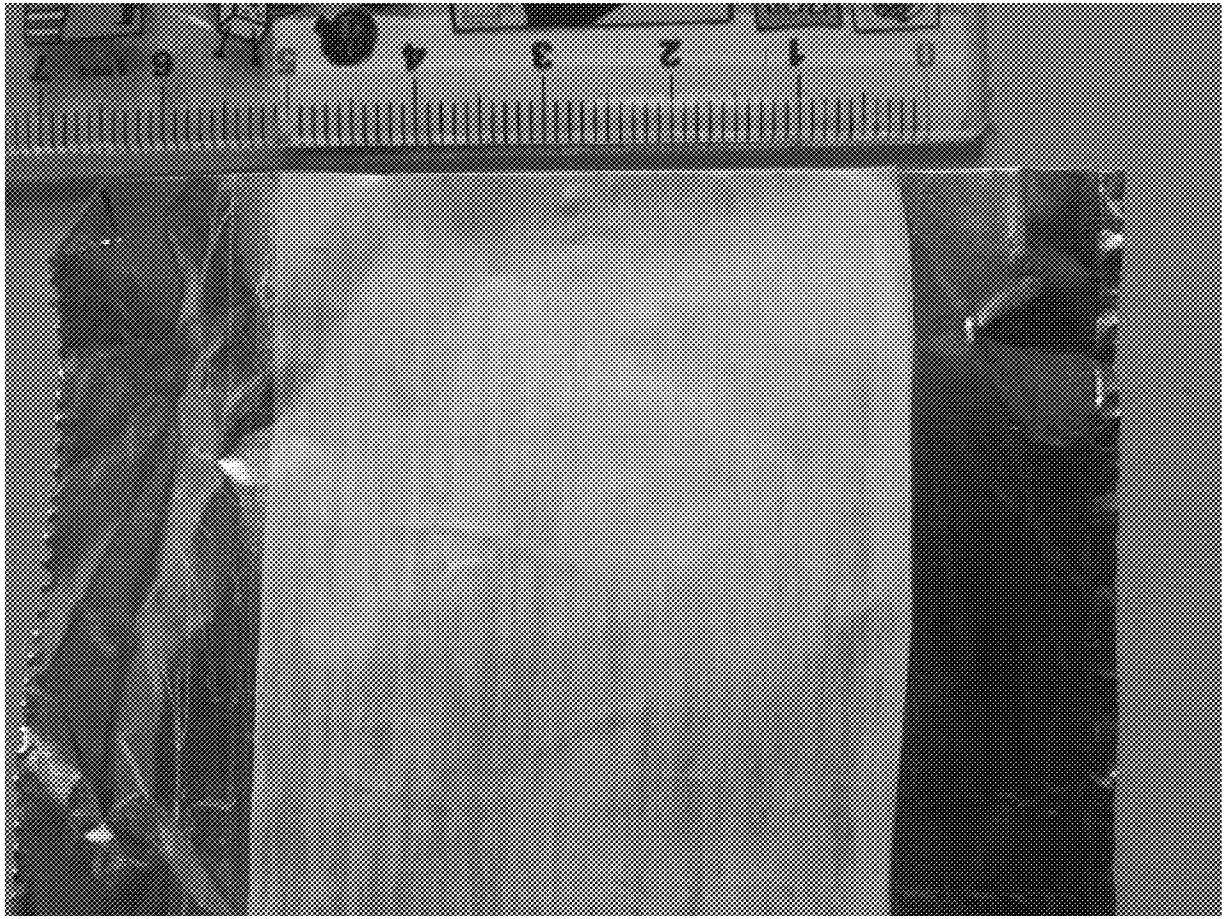
FIG. 4 shows poly-L-lactic acid (PLLA)-MTA membrane

Co-axial electrospinning was performed with following parameters: two different solutions for the electrospinning were PLLA solution (17 wt % in DCM/DMF (7:3) solution) and 10 wt % PEO/PEG (1:1) aqueous solution. PLLA solution was prepared as follows: PLLA dissolved in a 7:3 (volume ratio) mixture of DCM and DMF with the concentration of 17 wt %. The shell dopes (PLLA solution) and the core dopes (PEO/PEG solution) were delivered by a syringe pump at rates of 5 ml/hr and 6 ml/hr, respectively, with the applied electrostatic field of 2.5 kV/cm. The rotating collection unit was used to collect electrospun fiber with a linear speed of 1.09 m/sec and a sideway angular motion of 0.115°/s. After 10 min of collection, flat, as-spun membrane, with the dimension of 4.9×40 $cm^2$ was collected, as shown in FIG. 4.

Example 3

Three Dimensional MTAM Structure

Figure 5:
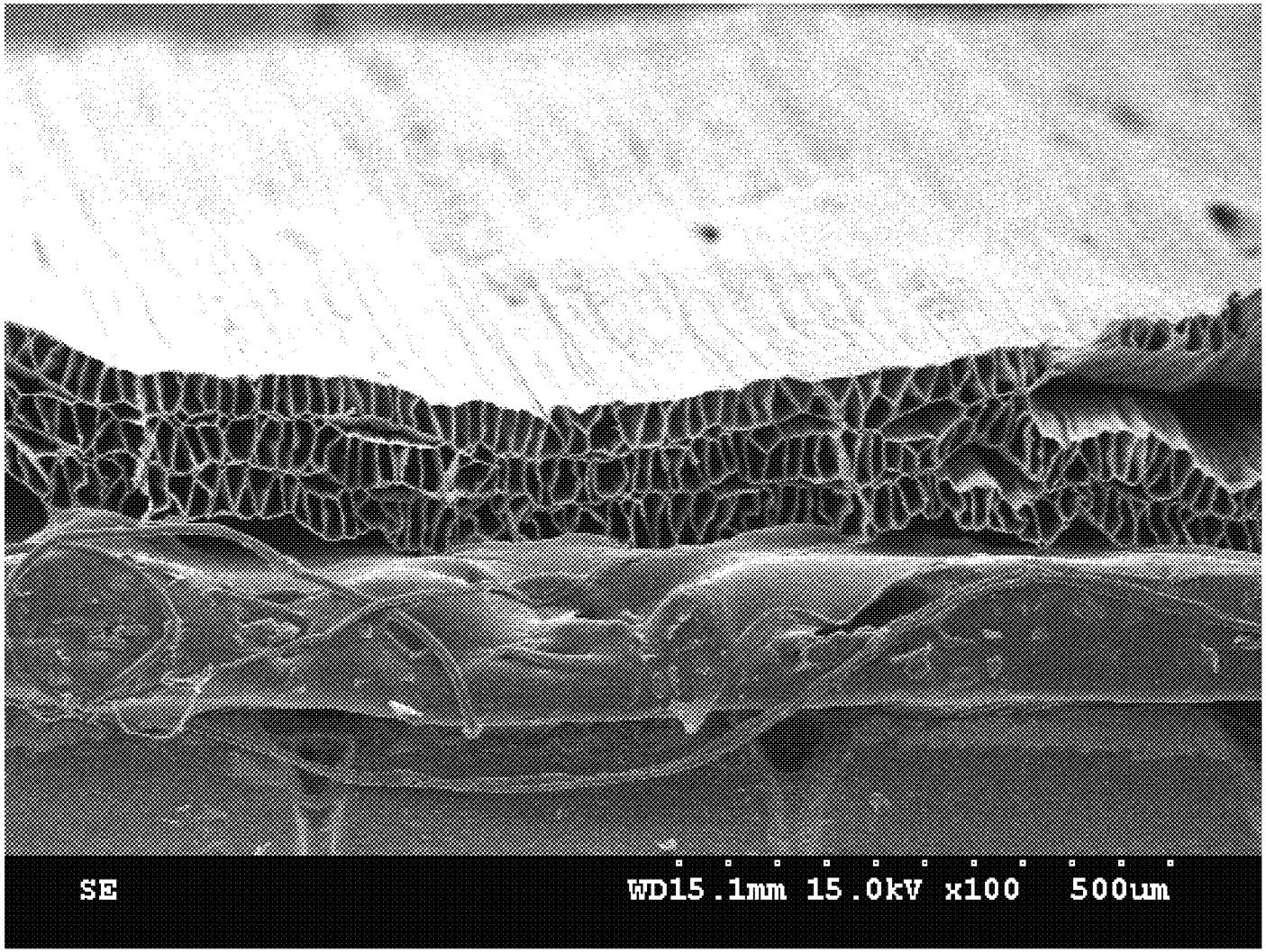
FIG. 5 shows a three-layered PLLA-MTA membrane.

Example 3 was carried out with the same electrospinning conditions as those in Example 2, except that the sideway motion (15 microns/sec) was introduced with a full range of 2 cm and controlled forward, backward and forward fashion to the system, so that flat MTAMs could be deposited in several ways, such as layer-by-layer, for up to 10 or more layers, as shown in FIG. 5, a deposition of three layers of MTAM.

Example 4

Brush-Like Three Dimensional MTAM Substrate

Figure 6:
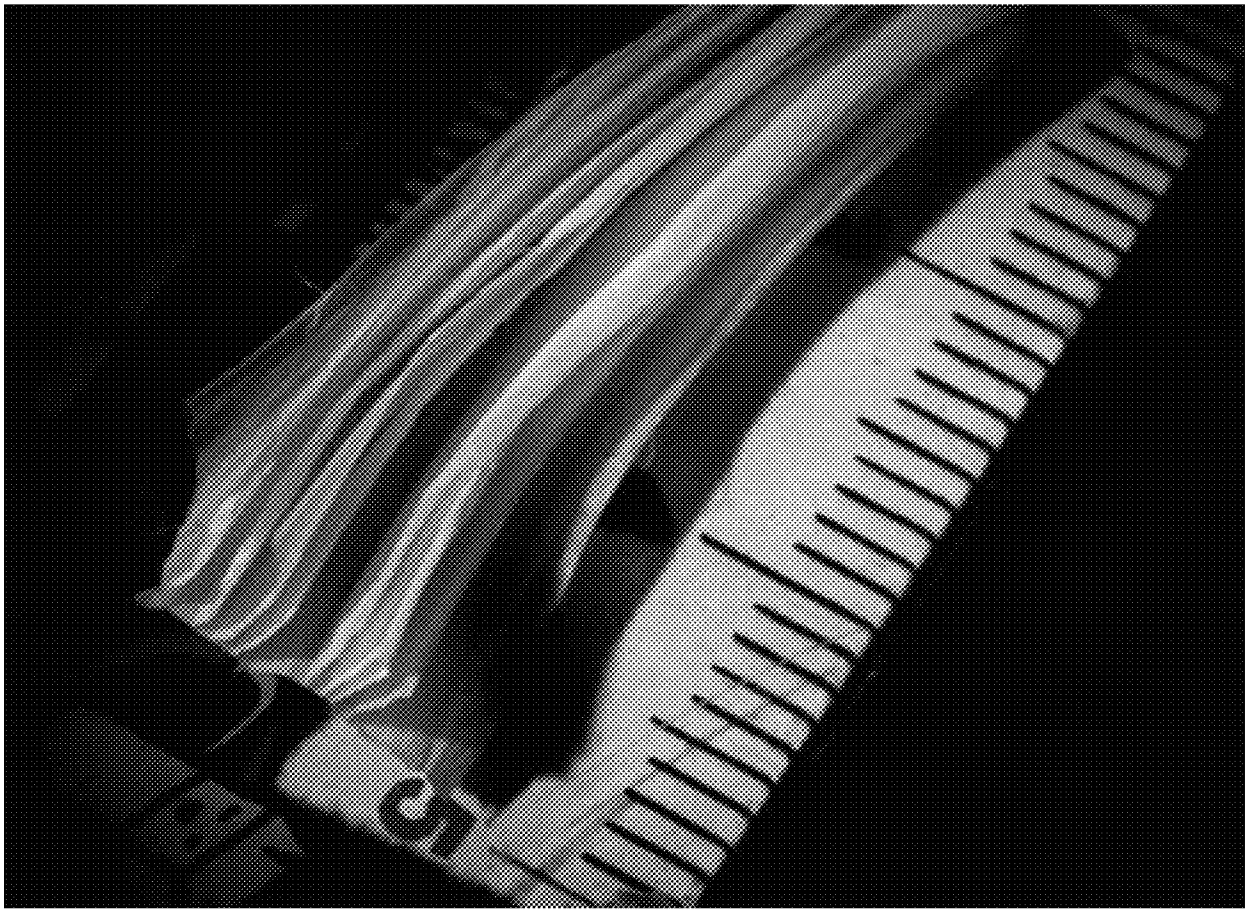
FIG. 6 shows three-dimensional brush-like MTA membrane substrate.

Same as example 3, but the motion was conducted in a circular "move, stop, and move" fashion. The resulting MTAM was in a three-dimensional brush-like structure, as shown in FIG. 6.

Example 5

Polycarbonate (PC)-MTAM Fabrication 11 wt % of polycarbonate (PC) in DCM solution was prepared as a shell dope, while a 10 wt % PEO/PEG (1:1) aqueous solution was used as a core dope and delivered to the co-axial spinneret at rates of 2.3 and 4.5 ml/hr, respectively. The electrospinning process was conducted with the operational parameters described as follows: applied electrostatics field strength of 1.5 kV/cm, collected at a speed of 1.3 m/sec and sideway angular motion of 0.029 degrees per sec (°/s) in a controlled environment with a temperature of 25° C. and RH of 75%. After a five-minute collection, an off-white membrane with a size of 1.1×30 $cm^2$ was collected, as shown in FIG. 7(*a*). Its SEM image was shown as FIG. 7(*b*), wherein the typical structure of a microtube array formation can be clearly seen.

Example 6

Figure 8:
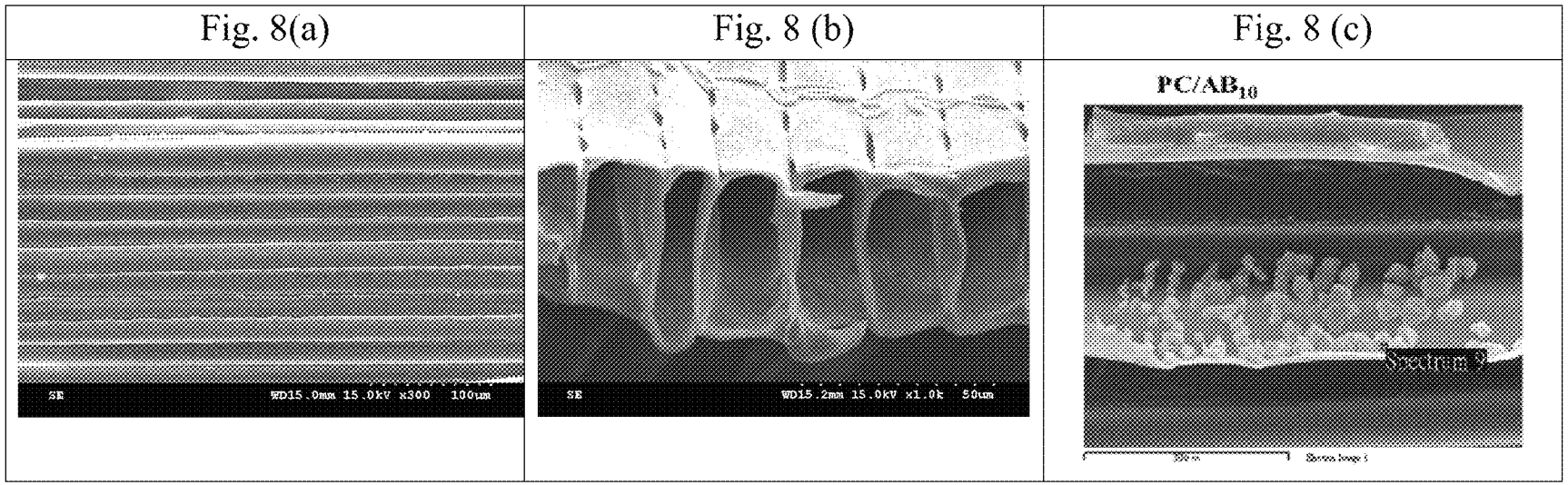
FIG. 8(*a*) shows the SEM image of the surface view of polycarbonate/ammonia borane (PC/AB) microcomposite MTA membrane.

Polycarbonate/Ammonia Borane (PC/AB) Microcomposite MTAM Fabrication 11 wt % of polycarbonate/Ammonia Borane (PC/AB (: 80/20)) in DCM solution was prepared as a shell dopes, while a 10 wt % PEO/PEG (1:1) aqueous solution was used as a core dope and delivered to the co-axial spinneret at rates of 2.3 and 4.5 ml/hr, respectively. The electrospinning process was conducted in the same way as those in Example 5. After a five-minute collection, an off-white membrane with a size of 1×30 cm was collected. Its SEM image was shown as FIGS. 8(*a*) and (*b*), wherein the typical structure of a microtube array formation can be clearly seen. As shown in FIG. 8(*c*), the AB crystals inside the lumen of MTAM were seen after the PC-MTA was torn apart.

Example 7

Cellulose Acetate (CA) MTAM Preparation 10 wt % of cellulose acetate (CA) in DCM/DMF (9:1) solution was prepared as a shell dope, while a 10 wt % PEO/PEO (1:1) aqueous solution was used a as core dope, and the dope and the core dope were delivered to the co-axial spinneret at rates of 5 and 5 ml/hr, respectively. The electrospinning process was conducted with the operational parameters described as follows: electrostatics field strength of 1.8 kV/cm, collected at a speed of 1.9 m/sec and in a controlled environment with a temperature of 25° C. and RH of 75%. After a six-minute collection, an off-white membrane with a size of 2.5×24 $cm^2$ was collected. Its SEM images show that the typical structure of a microtube array formation can be clearly seen.

Example 8

Preparation of Porous PLLA-MTAM

Figure 9:
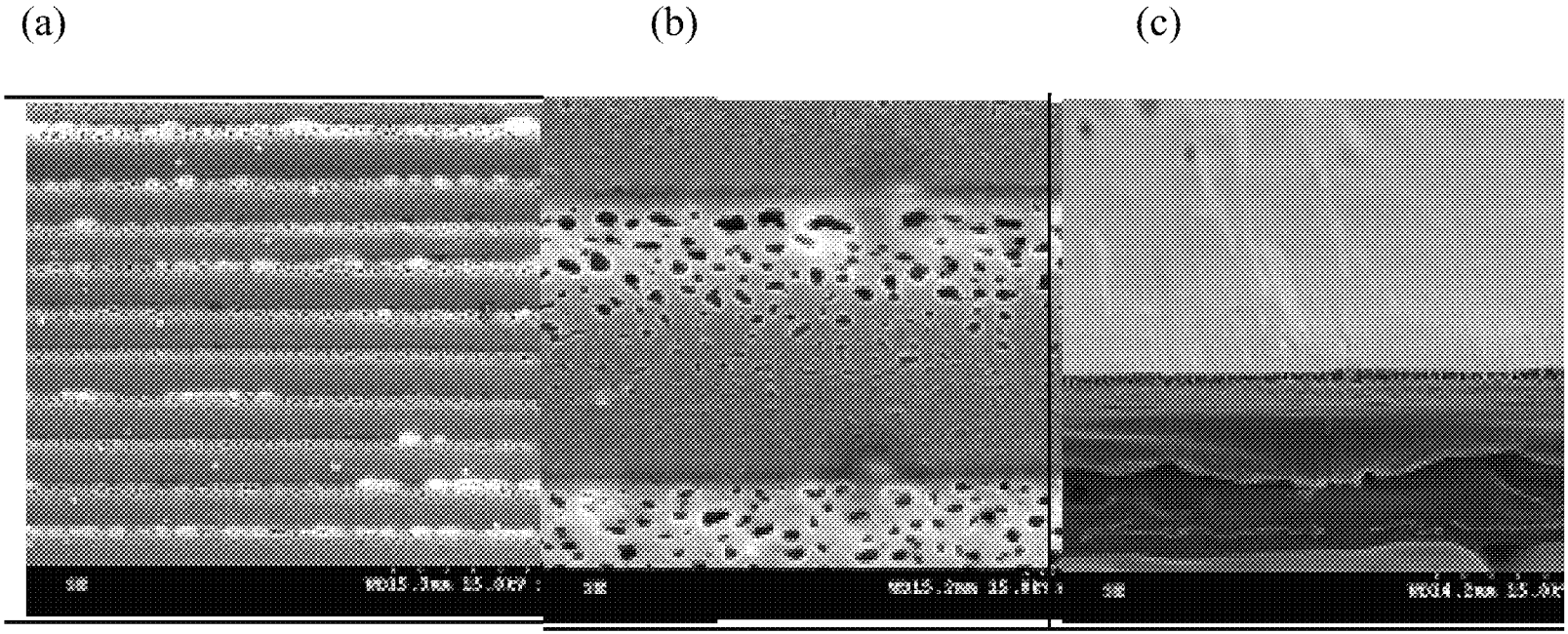
FIGS. 9(*a*) and (*b*) show the SEM images of the surface view of the porous PLLA-MTA membrane.

The process called for the same materials and operational condition as those in Example 1, with only one exception, i.e. PLLA solution was replaced with PLLA/PEG (60:40) in DCM/DMF solution. The faster collecting speed of 2.5 m/sec was used with side (y-direction) motion of 0.9°/sec. The resulting membrane was roughly 2×30 $cm^2$ after a seven-minute collection. After the washing process to remove the PEO component, a porous PLLA-MTAM was obtained. FIGS. 9(*a*) and (*b*) are the SEM images of the surface view of the porous PLLA-MTAM, while FIG. 9(*c*) is the SEM image of the side view of porous PLLA-MTAM.

Example 9

Preparation of Cell Seeded Porous PLLA-MTAM

Figure 10:
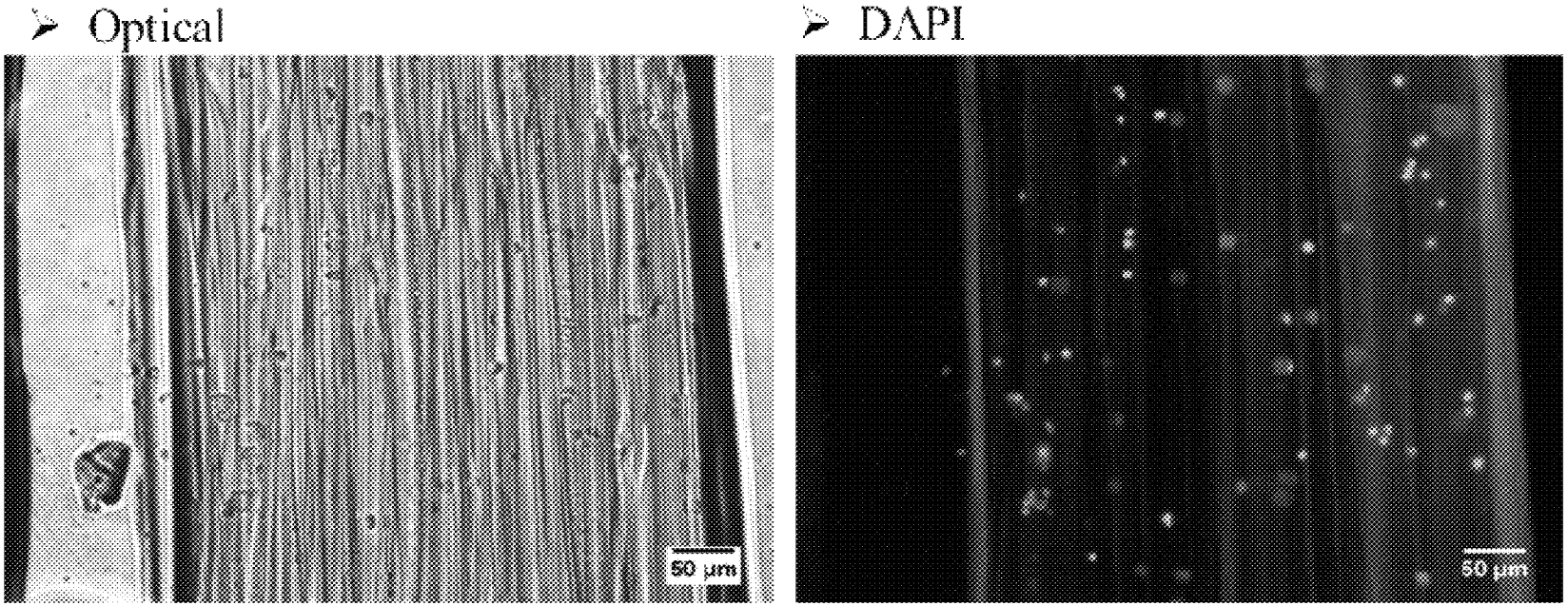
FIG. 10 shows the optical (left) and corresponding fluorescent image (right) of obtained sample treated with 4',6-diamidino-2-phenylindole (DAPI).

The inner aqueous solution (inner dope) was added with PC-12 cell on top of the original polymer (PEO/PEG, 1:1) 4 wt % aqueous solution, while 10 wt % of PLLA/PEG (70:30) in DCM/DMF (9:1) solution was used as a shell dope. The electrospinning was conduct with a field-strength of 0.7 kV/cm, with the flow rates of 3 and 4 ml/hr for the inner dope and the shell dopes, respectively. The collecting speed of 1.1 m/sec was used with side (y-direction) motion of 0.89°/s. The resulting membrane was roughly 1×30 cm after a three-minute collection. The as-spun cell seeded PLLA-MTAM was obtained in a fully extended fashion. FIG. 10 shows the optical and corresponding fluorescent image of the obtained sample treated with 4',6-diamidino-2-phenylindole (DAPI).

What is claimed is:

1. An electrospinning apparatus, which comprises one or more spinneret, a rotating collector disposed from the spinneret and configured to collect the fibers, and a sideway motion device disposed on or connected to the spinneret or the rotating collector and configured to propel or move the spinneret or the rotating collector, wherein the sideway motion device is controlled by a controlling unit for providing an angular speed (θ) of the sideway motion with a formula: $\theta=\tan^{-1} x/H$ wherein x is a parallel motion speed of the device ranging from about 2 to about 50 micrometers/sec and H is a vertical height between the spinneret and the rotating collector ranging from about 1 cm to about 30 cm and wherein the angular speed (θ) is in a range of about $1.0\times10^{-4}$ to about 1.0 (°/sec).

2. The electrospinning apparatus of claim 1, wherein the spinneret is a coaxial spinneret.

3. The electrospinning apparatus of claim 1, wherein the sideway motion device is disposed on the spinneret.

4. The electrospinning apparatus of claim 1, wherein the sideway motion device is connected to the spinneret.

5. The electrospinning apparatus of claim 1, wherein the controlling unit is set in a computer.

6. The electrospinning apparatus of claim 1, wherein the angular speed ranges from $1.0\times10^{-4}$ to about 0.6 (°/sec).

7. The electrospinning apparatus of claim 1, wherein the angular speed ranges from $1.89\times10^{-4}$ to about 0.573 (°/sec).

8. The electrospinning apparatus of claim 1, wherein the angular speed ranges from 0.01 to about 0.1 (°/sec).

9. The electrospinning apparatus of claim 1, wherein the parallel motion speed of the device ranges from about 6 to about 30 micrometers/sec.

10. The electrospinning apparatus of claim 1, wherein the vertical height between the spinneret and the rotating collector ranges from about 2 cm to 20 cm.

11. The electrospinning apparatus of claim 1, wherein the vertical height between the spinneret and the rotating collector ranges from about 3 cm to 7 cm.

12. A method for preparing a MTA membrane or a MTA membrane substrate, comprising providing an electrospinning apparatus of claim 1, providing an electrospray medium, and electrospinning the electrospray medium with the electrospinning apparatus of claim 1, wherein a sideway motion is provided with an angular speed (θ) with a formula: $\theta=\tan^{-1} x/H$ wherein x is a parallel motion speed of the side motion ranging from about 2 to about 50 micrometers/sec and H is a vertical height between the spinneret and the collector ranging from about 1 cm to about 30 cm and wherein the angular speed (θ) is in a range of about $1.0\times10^{-4}$ to about 1.0 (°/sec).

13. The method of claim 11, wherein the angular speed ranges from $1.0\times10^{-4}$ to about 0.6 (°/sec).

14. The method of claim 12, wherein the angular speed ranges from $1.89\times10^{-4}$ to about 0.573 (°/sec).

15. The method of claim 12, wherein the angular speed ranges from 0.01 to about 0.1 (°/sec).

16. The method of claim 12, wherein the vertical height between the spinneret and the rotating collector ranges from about 2 cm to 20 cm.

17. The method of claim 12, wherein the vertical height between the spinneret and the rotating collector ranges from about 3 cm to 7 cm.

18. The of claim 1, wherein the parallel motion speed of the device ranges from about 8 to about 20 micrometers/sec.

* * * * *